US005649581A

United States Patent [19]

Kopel

[11] Patent Number: 5,649,581

[45] Date of Patent: Jul. 22, 1997

[54] PURSE HAVING REVERSIBLE EXTERIOR FLAP

[75] Inventor: David Kopel, Agoura Hills, Calif.

[73] Assignee: Koltov, Inc., Westlake Village, Calif.

[21] Appl. No.: 584,182

[22] Filed: Jan. 11, 1996

[51] Int. Cl.[6] ..... A45C 3/06; A45C 13/08; B65D 33/16

[52] U.S. Cl. ..... 150/103; 150/105; 150/118; 383/86

[58] Field of Search ..... 150/103–105, 150/118; 190/902; 383/89, 86

[56] References Cited

U.S. PATENT DOCUMENTS

| | | | |
|---|---|---|---|
| 1,562,408 | 11/1925 | Berkowitz | 150/103 |
| 1,587,891 | 6/1926 | Berkowitz | 150/103 |
| 1,747,801 | 2/1930 | Topal | 150/104 |
| 2,080,453 | 5/1937 | Kraut | 150/104 |
| 2,101,997 | 12/1937 | Goldberg | 150/104 X |
| 2,656,870 | 10/1953 | Wishnia | 150/104 |
| 2,784,756 | 3/1957 | Resnick | 150/103 |
| 2,798,524 | 7/1957 | Ryon | 150/103 |
| 4,027,710 | 6/1977 | Keebler | 150/103 |

FOREIGN PATENT DOCUMENTS

| | | | |
|---|---|---|---|
| 2629794 | 10/1989 | France | 150/103 |

*Primary Examiner*—Sue A. Weaver
*Attorney, Agent, or Firm*—Freilich, Hornbaker & Rosen

[57] ABSTRACT

A purse construction has an exterior flap which can be selectively reversed to orient either a first or second flap surface outwardly.

6 Claims, 3 Drawing Sheets

PURSE HAVING REVERSIBLE EXTERIOR FLAP

BACKGROUND OF THE INVENTION

This invention relates to a purse construction which enables an exterior flap to be reversed to cause either a first or second flap surface facing outwardly.

Women's purses are typically provided with a top closure flap having an outer surface, which has a texture and color which matches or complements the texture and color of the exterior surface of the purse body. For example, a purse body having a flat black exterior surface would typically have a flap with an outer surface of identical texture and color.

SUMMARY OF THE INVENTION

The present invention is directed to a purse construction having an exterior flap which can be selectively reversed to orient either a first or second flap surface outwardly.

In accordance with a preferred embodiment, the first and second flap surfaces contrast in at least one appearance characteristic, (e.g., color, texture, etc.) to enable a user to vary the exterior appearance of the purse. For example only, the flap first and second surfaces can be configured to respectively impart a more formal appearance for evening wear, and a sportier appearance for day wear.

In accordance with a preferred embodiment, a swivel mechanism is provided for attaching the flap to the purse body to enable the flap to be reversed to place either its first surface or its second surface outwardly. The swivel mechanism preferably includes first and second clasp members respectively attached to said flap and purse body. The clasp members are coupled together for relative swivel movement.

In accordance with a further aspect of the invention, the purse body defines a pocket for accommodating the swivel mechanism. Preferably, the second clasp member is connected to the purse body via an elastic member which extends into the pocket and is typically concealed from view.

DETAILED DESCRIPTION

Figure 1:
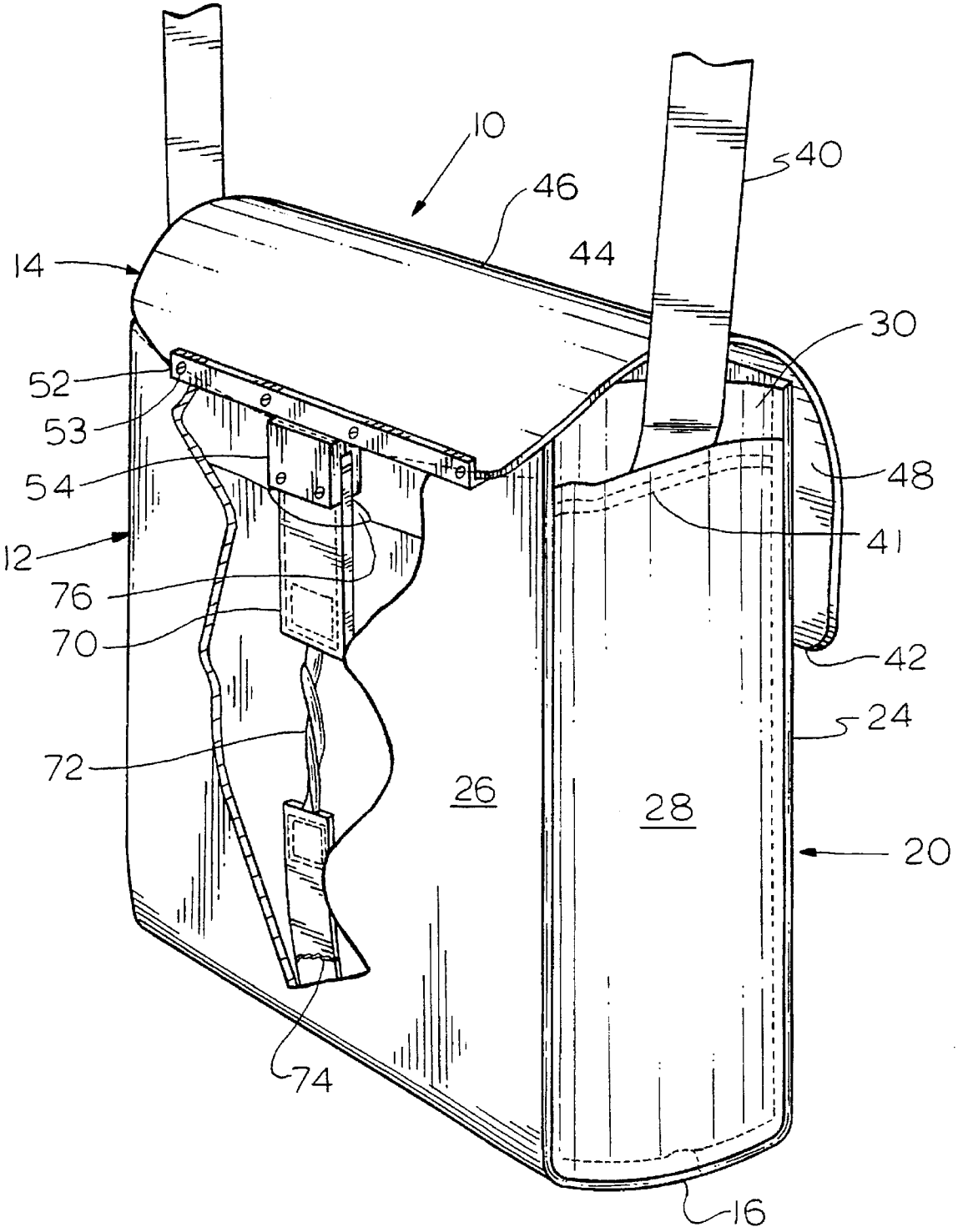
FIG. 1 is a perspective view of a preferred embodiment of the invention, partially broken away, to show the swivel mechanism for coupling a purse closure flap to a purse body.

Attention initially directed to FIG. 1 which illustrates a preferred embodiment of a purse 10 in accordance with the present invention. The purse 10 is basically comprised of a purse body 12 and an exterior closure flap 14.

Figure 3:
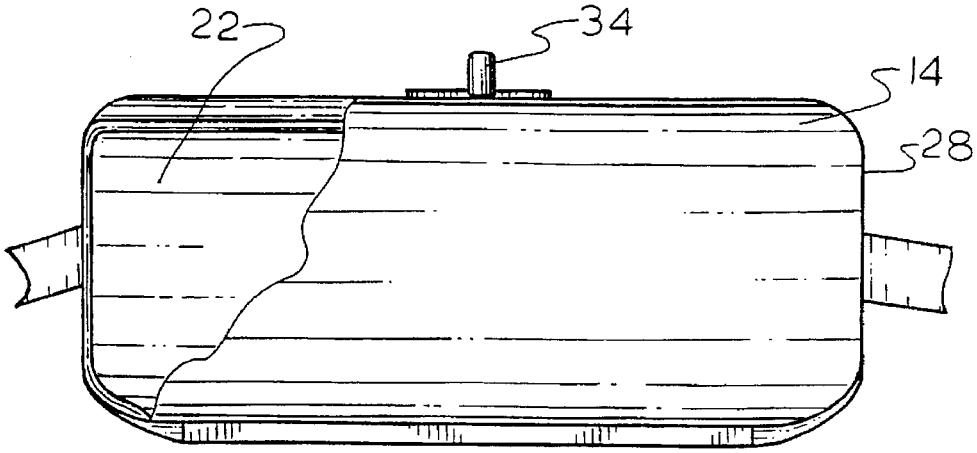
FIG. 3 is a top plan view of the purse of FIG. 1, partially broken away, to reveal its interior compartment.
Figure 4:
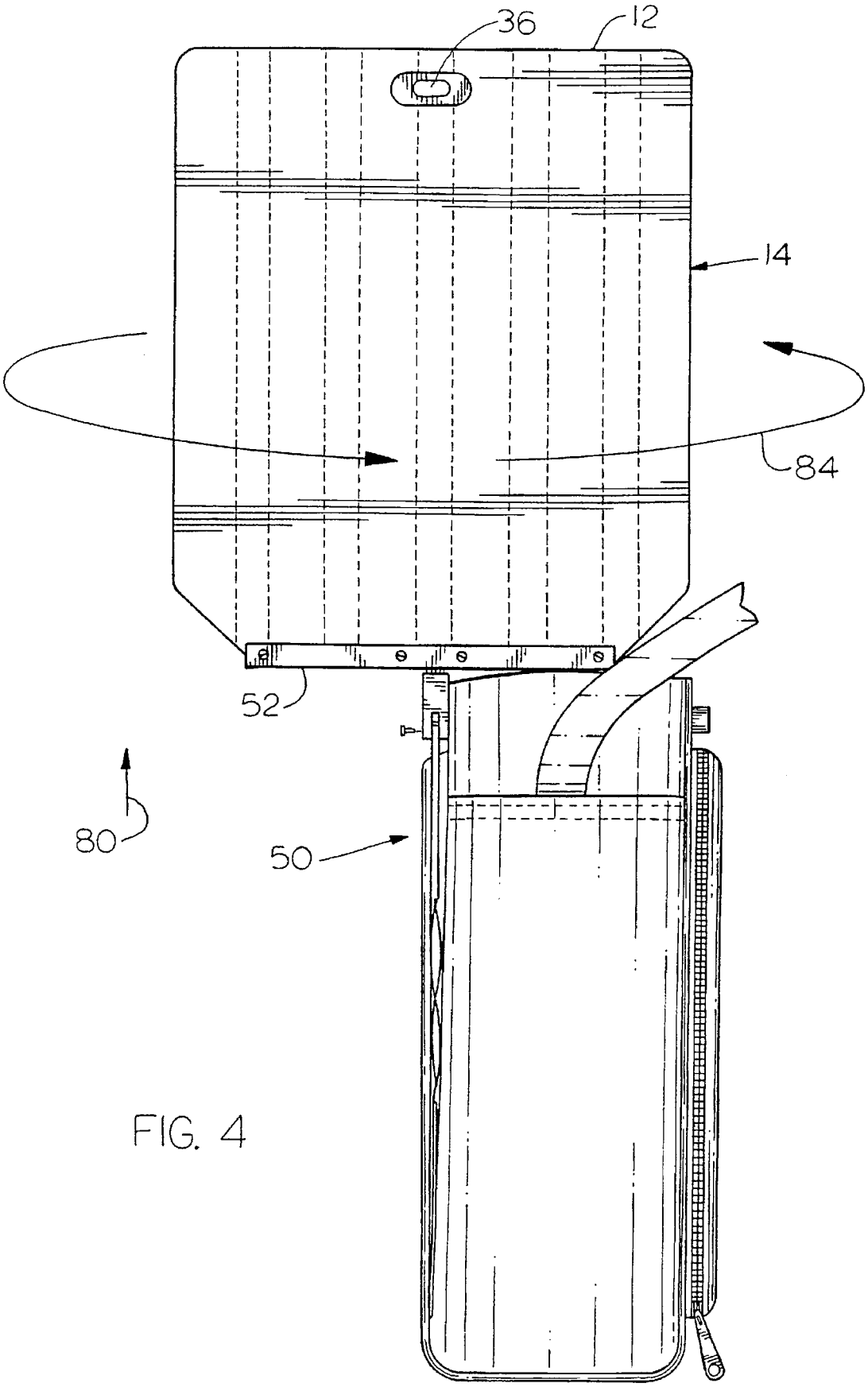
FIG. 4 is a side elevation view of the purse of FIG. 1 showing how the flap can be reversed to selectively orient either its first or second surface outwardly.

More particularly, the purse body 12 is depicted as including a bottom wall 16 and a peripheral wall 20 extending upwardly from the bottom wall 16 to define an interior compartment 22 (FIG. 3). More specifically, the peripheral wall 20 is comprised of a front wall section 24 a rear wall section 26 and first and second side wall sections 28. The peripheral wall 20 defines a top access opening 30 which opens to the interior compartment 22. The closure flap 14 is mounted so as to overlay the access opening 30. Preferably, as is depicted in FIG. 3 and FIG. 4, a rotatable latch element 34 is mounted exteriorly on front wall section 24 and dimentioned to pass through an aperture 36 in flap 14 for latching the flap in a closed position, as is depicted in FIG. 1. A strap 40 is typically secured to the purse body, as by stitching 41, to facilitate handling.

The flap 14 has a front edge 42 and a rear edge 44. In typical prior art purse constructions, the rear edge 44 is directly secured to the purse body. However, in accordance with the present invention, the flap rear edge 44 is secured to a swivel mechanism 50 which enables a user to selectively orient the flap 14 to place either its first surface 46 or second surface 48 outwardly.

Figure 2:
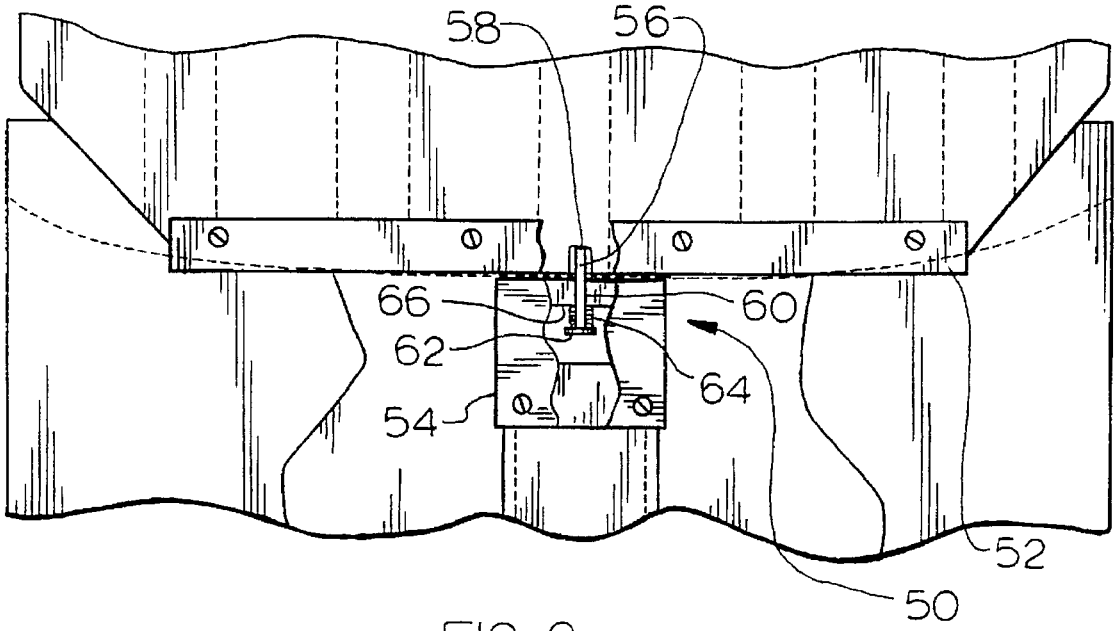
FIG. 2 is an enlarged view showing the swivel mechanism of FIG. 1.

More specifically, the swivel mechanism 50 includes a first clasp member 52, which is secured to the rear edge 44 of flap 14, as by screw fasteners 53. The swivel mechanism 50 additionally includes a second clasp member 54 coupled to the first clasp member 52 by a swivel pin 56 (FIG. 2). A first end 58 of pin 56 is secured to clasp 52, as by staking or by nut 59. The pin then extends through an opening 60 in clasp member 54. The pin second end 61 terminates at head 62. A spring 64 is mounted between the head 62 and surface 66 of clasp member 54. The pin is rotatable in opening 60, thus allowing the clasp member 52 to swivel about the axis of pin 56 relative to the clasp member 54.

Preferably, the clasp member 54 is secured to a strap 70 including an elastic portion 72 which is in turn terminally secured to the rear wall section 26 of purse body 20, as by stitching 74. Preferably, the strap 70 extends into a pocket 76 which essentially conceals the swivel mechanism.

In accordance with a preferred embodiment of the invention, the flap surfaces 46 and 48 are formed with different appearance characteristic. For example, the surfaces 46 and 48 may be of a different color or texture or pattern. This enables a user to choose between two different purse appearances by facing either surface 46 or surface 48 outwardly. In order to change the outward face, the user can pull upwardly (arrow 80, FIG. 4) by stretching the elastic band 72. This enables the clasp member 52 to move vertically above the top of the peripheral wall 20 so as to permit the flap 14 to be swiveled as represented by the arrows 84, FIG. 4.

Accordingly, it should now be understood that a new and useful purse construction has been disclosed herein which enables a user to change the exterior appearance of a purse by selectively orienting an exterior flap to place either a first or second surface outwardly. Although a specific embodiment of the invention has been disclosed, it should be recognized that a reversible flap in accordance with the invention could be advantageously utilized in innumerable purse variations and it is accordingly intended that the appended claims be so interpreted.

I claim:

1. A purse comprising:

a purse body having an exterior surface;

an exterior flap having oppositely facing first and second surfaces; and a swivel mechanism and elastic member attaching said flap to said purse body for enabling said flap to swivel relative to said body to selectively orient either said first surface or said second surface outwardly.

2. The purse of claim 1 wherein said first and second surfaces differ in at least one appearance characteristic.

3. The purse of claim 1 wherein said swivel mechanism includes first and second clasp members coupled together for swivel movement relative to each other; and means respectively attaching said first and second clasp members to said flap and said purse body.

4. A purse comprising:

a purse body having a bottom wall and a peripheral wall extending from said bottom wall to define an interior compartment having a top access opening;

said peripheral wall defining front and rear wall sections each having an exterior surface;

an exterior flap having first and second surfaces; and a swivel mechanism and elastic member attaching said flap to said purse body for enabling said flap to swivel and overlay said access opening with either said first surface or said second surface facing outwardly.

5. The purse of claim 4 wherein said swivel mechanism includes a pin having an axis; and first and second clasp members secured to said pin for swivel movement relative to each other around said pin axis.

6. The purse of claim 5 wherein said flap first and second surfaces differ in at least one appearance characteristic.

* * * * *